United States Patent [19]

Gulbrandsen

[11] 4,304,188

[45] Dec. 8, 1981

[54] LOCKER FOR PERSONAL VALUABLES

[76] Inventor: Jonny Gulbrandsen, Vardevegen 6, 1500 Moss, Norway

[21] Appl. No.: 149,012

[22] Filed: May 12, 1980

Related U.S. Application Data

[63] Continuation of Ser. No. 915,223, Jun. 13, 1978.

[30] Foreign Application Priority Data

Jun. 22, 1977 [NO] Norway ..... 772192

[51] Int. Cl.[3] ..... A45C 1/12; E05G 1/06

[52] U.S. Cl. ..... 109/53; 109/70; 109/74

[58] Field of Search ..... 109/58, 53, 58.5, 59 R, 109/64, 69, 70, 74; 232/4 R; 49/463, 465; 220/345, 331

[56] References Cited

U.S. PATENT DOCUMENTS

| | | | |
|---|---|---|---|
| 1,424,431 | 8/1922 | Agee | 49/463 |
| 2,800,090 | 7/1957 | Reid | 109/59 |
| 3,342,407 | 9/1967 | Riegraf | 232/4 R |
| 3,481,288 | 12/1969 | Teleky | 109/58 |
| 3,715,998 | 2/1973 | Teleky | 109/58 |
| 3,842,761 | 10/1974 | Bloom | 109/59 |

FOREIGN PATENT DOCUMENTS

| | | | |
|---|---|---|---|
| 380160 | 9/1932 | United Kingdom | 49/463 |

*Primary Examiner*—Reinaldo P. Machado
*Attorney, Agent, or Firm*—Howson and Howson

[57] ABSTRACT

The invention provides a locker for the safe-keeping of personal valuables, comprising a hollow body portion provided with an opening, an inner abutment means extending around at least part of the inner periphery of said opening, a door adapted to fit into said opening against said inner abutment means, and at least one outer abutment means on part of the inner periphery of said opening, said inner and outer abutment means defining between them a gap to receive the edge of the door, and said outer abutment means being partially curved to enable the door to be tilted away from said opening, about an edge thereof, and thereby be removed from said opening without being lifted, and a lock having an arm for engaging the body portion when the door is locked in the closed position to prevent the door from being tilted outwardly.

4 Claims, 2 Drawing Figures

LOCKER FOR PERSONAL VALUABLES

Figure 2:
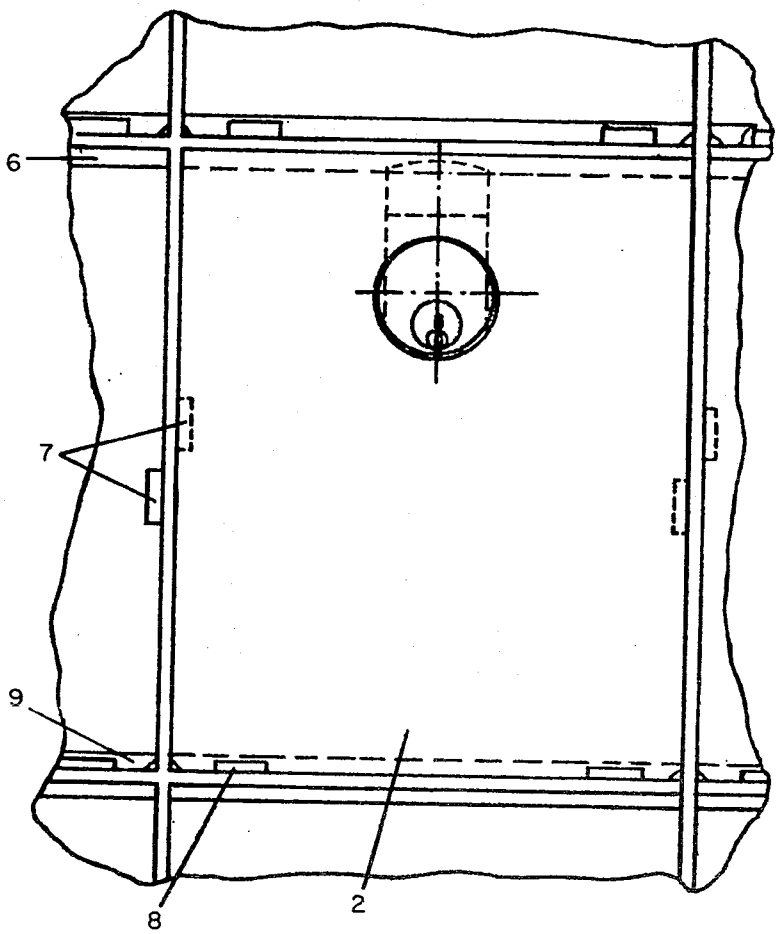

This is a continuation of application Ser. No. 915,223, filed June 13, 1978.

The present invention relates to a system for lockers for personal valuables, where non-hinged doors can be inserted and removed resp. in an especially simple and easy manner and are standardized, so that any door fits any locker.

For the safe-keeping of personal valuables in connection with a visit to a public institution, e.g. a public bath or a gymnasium etc., lockers having hinged doors that are lockable by borrowed keys are commonly used today. In existing locker systems a door, a lock and a key are associated with one locker and one place. A disadvantage of lockers of this kind is that the keys can be copied, which makes the locker a not very safe place for personal valuables. Another disadvantage is that the doors are often subjected to rough handling, which primarily results in damaged hinges and expensive reparations.

Another kind of lockers or security boxes is known and especially meant for use in private homes, hotels or the like for the safe-keeping of personal valuables. Reference is made to the U.S. Pat. Nos. 2,800,090, 3,715,998, and 3,842,761. The boxes described in said specifications are all so-called safe-like boxes that are firmly anchored preferably in solid walls, every box forming a relatively large and separate unit. Another common feature of the mentioned boxes is that their doors are not provided with hinges, but are freely insertable and removable. The closing and locking means of the boxes according to said U.S. specifications are relatively complicated and require several different manual operations to bring about various positions of the doors when they are to be inserted or removed resp. It is obvious that said doors are not meant to be taken along in a hand bag or the like.

It is a primary object of the present invention to provide lockers that are not very sensitive to strain or violence from the outside and are not provided with door keys that are easily copied because they are kept by different persons for some time.

According to the invention a system of lockers is provided where the locker spaces consist of open holes devoid of movable parts and standardized doors having no hinges and being simply and easily removable and insertable as well as lockable. Each locker comprises a preferably square door provided with a locking means and a preferably square space having a corresponding rectangular preferably square opening, near which retaining rims and/or retaining knobs are provided in the periphery of said space to form contact surfaces for the door, whereby the upper retaining rim preferably forms part of the locking means. The locker is characterized in that for locking the lower edge of the door specially shaped retaining knobs are provided at a distance from and outside the lower locker rim or retaining knobs, the first mentioned retaining knobs having a sectional shape where the innermost portion forms a straight vertical surface towards the front of the door to the necessary degree for retaining the door in a locked position, and where the upper portion of the retaining rim or knobs is curved outwards from the door, so as to permit the door to be taken out without being lifted, and so as to prevent the door from wedging even in case of small tolerances.

Another feature of the present invention is that all doors and all lockers have equal dimensions, so that any door will fit in any locker space.

Figure 1:
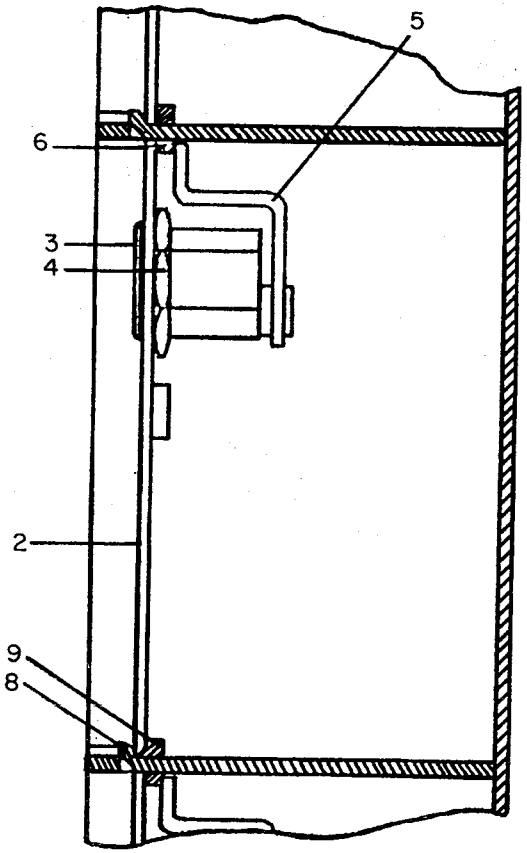

The invention is described in detail below with reference to the enclosed drawing, which represents a preferred embodiment and wherein FIG. 1 is a sectional view of a locker and FIG. 2 is a front view of said locker.

The figure, thus, shows a locker 1 having a door 2. The upper and lower inside walls of the locker are provided with rims 6 and 9 resp., and the side walls are provided with knobs 7, which form contact faces for the door 2. The door is shown in a locked position, the arm 5 being in contact with the rearward edge surface of the rim 6, portions of the lower door edge also being in contact with the vertical surface of the specially shaped retaining knobs 8. The door is provided with a lock 3 with an associated retaining nut 4.

The drawing only discloses one preferred embodiment of the invention, and it will be obvious that modifications can be made within the scope of the present invention. Thus, the knobs disclosed in the figures may e.g. be provided in a different number or replaced by rims. The invention, however, is primarily associated with the special shape of knobs 8. For inserting the door into a locker 1 the lower edge of the door is pushed down and in between the rim 9 and the knobs 8, the door meanwhile being tilted in such a manner that the upper portion of the door is tilted away from the locker. Then the door is pushed in and into its locking position so as to be in contact with the knobs 7 and rims 6 and 9 resp. By turning a key (not shown) in the lock 3 the locking arm 5 is turned so that its end portion is brought into contact with a portion of the inner surface of the rim 6. To remove the door 2 the locking arm 5 is turned away from rim 6, the door is tilted outwards with its upper portion and is removed by an almost negligible lifting movement. The specially shaped retaining knobs 8 make it simple and easy both to insert and to remove the locker door. The shape of the retaining knobs 8 also permits better adaption of the dimensions of the door to the locker opening. According to a preferred embodiment the lower edge of the door, which is in contact with the inside retaining rim of the locker can be rounded. In that manner the handling of the door will be very simple and easy for inserting or removing the door.

The number of lockers for one assembly will usually be approximately 50 or more. The door with its associated key is brought by the owner in his or her hand bag or the like, when the owner for instance visits a gymnasium or the like. The door fits all locker openings and can, thus, be used for an empty locker according to the door owners choice. The security of this system not only lies in the different door keys, but also in the fact that the door is not secured in one and the same locker every time it is used, but can be used with different lockers for each visit. Another advantage of the lockers according to the invention is that there is no need for a person at the gymnasium or the like to deliver and collect keys resp.

I claim:

1. In a locker for the safe-keeping of articles, of the class comprising a storage chamber for storing said articles and having a rectangular vertically-extending front opening, a door adapted to be placed into said front opening to close it when said chamber is being used to store said articles and adapted to be removed completely from any connection to said chamber when said chamber is not being used to store said articles, a locking arm and lock on said door, inner abutment means secured to and extending at least partly around the inner periphery of said chamber, recessed within said chamber, and extending inwardly with respect to said opening, for receiving said door in abutting relationship thereto when said door is placed into said front opening, door retaining means extending about only a part of said front opening forwardly of said inner abutment means so as to define a gap between said door retaining means and said inner abutment means for receiving an edge of said door in said gap, said lock and said locking arm being operable to move said arm into engagement with said inner abutment means on the opposite side of said chamber from said gap, in the secured condition of said door, and to move said arm out of engagement with said inner abutment means to permit removal of said door, the improvement wherein:

said door retaining means has, on a first portion thereof adjacent the front of said door when said door is in position in said front opening, a substantially flat surface extending substantially perpendicularly to the interior of said chamber and parallel to said door sufficiently to retain said door against removal by forward translational movement thereof, and has a second curved portion extending from said first portion inwardly with respect to said front opening and outwardly from said door for enabling said door to be tilted outwardly about the edge thereof in said gap and then withdrawn from all connection to said chamber, when said locking arm is out of engagement with said inner abutment means.

2. The locker of claim 1, wherein said vertical front opening has a top edge and a bottom edge and said inner abutment means is of bar-like form and extends at least along said top edge of said front opening.

3. The locker of claim 1 in which said door retaining means extends only along said bottom of said front opening.

4. The locker of claim 1, wherein the edge of said door which comes into abutting contact with said inner abutment means within said gap is rounded.

* * * * *